US010941938B2

(12) United States Patent
Tibbs et al.

(10) Patent No.: US 10,941,938 B2
(45) Date of Patent: Mar. 9, 2021

(54) FUEL INJECTORS INCLUDING GAS FUEL INJECTION

(71) Applicant: Delavan Inc., West Des Moines, IA (US)

(72) Inventors: Andy W. Tibbs, Earlham, IA (US); Gregory A. Zink, Des Moines, IA (US); Thomas J. Ocken, Des Moines, IA (US); Lev Alexander Prociw, Johnston, IA (US)

(73) Assignee: Delavan Inc., West Des Moines, IA (US)

( * ) Notice: Subject to any disclaimer, the term of this patent is extended or adjusted under 35 U.S.C. 154(b) by 168 days.

(21) Appl. No.: 15/902,800

(22) Filed: Feb. 22, 2018

(65) Prior Publication Data

US 2019/0257520 A1 Aug. 22, 2019

(51) Int. Cl.

| | |
|---|---|
| ***F23R 3/14*** | (2006.01) |
| ***F23R 3/26*** | (2006.01) |
| ***F23R 3/28*** | (2006.01) |

(52) U.S. Cl.

CPC ..... *F23R 3/14* (2013.01); *F23R 3/26* (2013.01); *F23R 3/28* (2013.01); *F23R 3/286* (2013.01); *F23C 2900/07001* (2013.01)

(58) Field of Classification Search

CPC ... F23R 3/14; F23R 3/286; F23C 2900/07001
See application file for complete search history.

(56) References Cited

U.S. PATENT DOCUMENTS

| | | | | |
|---|---|---|---|---|
| 3,455,108 A * | 7/1969 | Clare Harold | F23D 11/108 | 60/749 |
| 5,351,477 A * | 10/1994 | Joshi | F23C 7/004 | 239/400 |
| 6,438,961 B2 * | 8/2002 | Tuthill | F23C 7/004 | 60/776 |
| 6,675,581 B1 * | 1/2004 | Stuttaford | F23R 3/286 | 60/737 |
| 7,490,471 B2 * | 2/2009 | Lynch | F23C 7/004 | 60/748 |

(Continued)

FOREIGN PATENT DOCUMENTS

JP H09137946 A 5/1997

OTHER PUBLICATIONS

Extended European search report issued in corresponding European patent application No. 19158626.2, dated Jul. 1, 2019.

*Primary Examiner* — William H Rodriguez
(74) *Attorney, Agent, or Firm* — Locke Lord LLP; Daniel J. Fiorello; Scott D. Wofsy

(57) ABSTRACT

In accordance with at least one aspect of this disclosure, a fuel injector can include an annular body defining a gas fuel inlet therein, and a structure extending radially outward from the annular body and configured to extend into an air circuit. The structure can include a gas channel defined within the structure at least partially along a radial length of the structure. The gas channel is in fluid communication with the gas fuel inlet where the structure meets the annular body. The structure also includes a slot opening defined at least partially along a radial length of the structure and configured to fluidically connect the gas channel and the air circuit to all gas fuel to effuse into the air circuit.

10 Claims, 8 Drawing Sheets

(56) References Cited

U.S. PATENT DOCUMENTS

| | | | | |
|---|---|---|---|---|
| 8,104,286 | B2 * | 1/2012 | Zuo | F23R 3/14 60/748 |
| 2004/0006989 | A1 * | 1/2004 | Stuttaford | F23R 3/286 60/776 |
| 2004/0006990 | A1 * | 1/2004 | Stuttaford | F23R 3/286 60/776 |
| 2004/0006991 | A1 * | 1/2004 | Stuttaford | F23L 7/002 60/776 |
| 2004/0006992 | A1 * | 1/2004 | Stuttaford | F23R 3/286 60/776 |
| 2005/0262847 | A1 * | 12/2005 | Koshoffer | F23R 3/20 60/761 |
| 2005/0268618 | A1 * | 12/2005 | Johnson | F23R 3/14 60/776 |
| 2006/0080966 | A1 * | 4/2006 | Widener | F02C 3/20 60/775 |
| 2006/0236700 | A1 | 10/2006 | Saitoh et al. | |
| 2008/0078182 | A1 * | 4/2008 | Evulet | F02C 3/14 60/776 |
| 2008/0078183 | A1 | 4/2008 | Ziminsky et al. | |
| 2010/0077760 | A1 * | 4/2010 | Laster | F23C 7/004 60/742 |
| 2010/0170255 | A1 | 7/2010 | Zuo et al. | |
| 2010/0180599 | A1 * | 7/2010 | Thomas | F23R 3/14 60/737 |
| 2010/0287938 | A1 * | 11/2010 | Singh | F23C 7/004 60/740 |
| 2012/0023952 | A1 * | 2/2012 | Vandervort | F23C 6/045 60/748 |
| 2013/0067920 | A1 * | 3/2013 | Fox | F23R 3/14 60/738 |
| 2014/0291418 | A1 | 10/2014 | Ruffing et al. | |

* cited by examiner

FUEL INJECTORS INCLUDING GAS FUEL INJECTION

BACKGROUND

1. Field

The present disclosure relates to fuel injectors, more specifically to fuel injectors that include gas fuel injection, e.g., as well as liquid fuel injection.

2. Description of Related Art

In existing diffusion flame injectors, during no or low air purge flow through the gaseous fuel circuit, the liquid fuel backflows onto the outer portion of the prefilmer where carbon grows. This is because the gaseous fuel circuit gap acts as separation point of the outer air circuit so that there is a recirculation zone where the liquid fuel droplets will accumulate as carbon. This carbon growth can potentially cause gaseous fuel circuit to be at least partially blocked.

Such conventional methods and systems have generally been considered satisfactory for their intended purpose. However, there is still a need in the art for improved fuel injectors. The present disclosure provides a solution for this need.

SUMMARY

In accordance with at least one aspect of this disclosure, a fuel injector can include an annular body defining a gas fuel inlet therein, and a structure extending radially outward from the annular body and configured to extend into an air circuit. The structure can include a gas channel defined within the structure at least partially along a radial length of the structure. The gas channel is in fluid communication with the gas fuel inlet where the structure meets the annular body. The structure also includes a slot opening defined at least partially along a radial length of the structure and configured to fluidically connect the gas channel and the air circuit to allow gas fuel to effuse into the air circuit.

In certain embodiments, the fuel injector can include a plurality of the structure. In certain embodiments, the fuel injector can include an air shroud attached to or formed from a radially outward end of the structure to define the air circuit. It is contemplated herein the air shroud can be attached to the annular body in any other suitable manner. In certain embodiments, at least some of the structures, e.g., all, can include an airfoil shape such that the structure is a vane of an air swirler that is configured to swirl air in the air circuit. It is contemplated that one or more, e.g., all, of the structures need not extend across the entire air circuit and can be any suitable radial length.

The slot opening can be defined through a convex low pressure side of the airfoil shape. In certain embodiments, the slot opening can be defined through a concave high pressure side of the airfoil shape. In certain embodiments, the slot opening can be defined in a trailing edge of the airfoil shape.

In certain embodiments, the gas channel and the slot opening can be defined along the entire length of the structure. However, the gas channel and/or the slot opening can be defined only partially along the radially length of the structure, and it is contemplated that the gas channel can be longer than the slot opening.

The gas channel can be sized and/or shaped relative to the slot opening to cause uniform flow distribution through the slot opening to cause flow ribboning. For example, the slot opening can constrict flow from the gas channel (e.g., by a stepped reduction in flow area to affect pressure to cause gas to fill the gas channel uniformly). In certain embodiments, the gas channel and the slot opening can be defined by a single smoothly reducing channel.

In certain embodiments, the fuel injector can include an additional gas outlet to allow gas fuel to effuse from the gas fuel inlet. The additional gas outlet can be defined axially through the annular body. In certain embodiments, the additional gas outlet can be defined radially outward of the air circuit in an air shroud in fluid communication with the air circuit, and the additional gas outlet can be in fluid communication with the gas fuel inlet of the annular body through a strut that passes through the air circuit.

In certain embodiments, the fuel injector can include a second air shroud disposed radially outward of the air shroud that is formed from or attached to the structure. The second air shroud can define a second air circuit. In certain embodiments, an additional gas outlet can be included to allow gas fuel to effuse from the gas fuel inlet such that the additional gas outlet is defined between the air shroud that is formed from or attached to the structure or the second air shroud. The additional gas outlet can be in fluid communication with the second air circuit.

In certain embodiments, the fuel injector can include a liquid fuel circuit and/or an inner air flow channel defined by the annular body. The inner air flow channel can include an inner air swirler, for example.

In accordance with at least one aspect of this disclosure, a method for making a fuel injector can include forming a structure as described above. Forming the structure can include additively manufacturing the structure, or forming the structure to include an entirely internal gas channel and cutting a trailing edge off of the structure to form the slot opening, for example. Any other suitable method of forming is contemplated herein.

In accordance with at least one aspect of this disclosure, an air circuit strut for a fuel injector can include a gas channel defined therein and open through a slot opening in fluid communication with air in the air circuit.

These and other features of the systems and methods of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1:
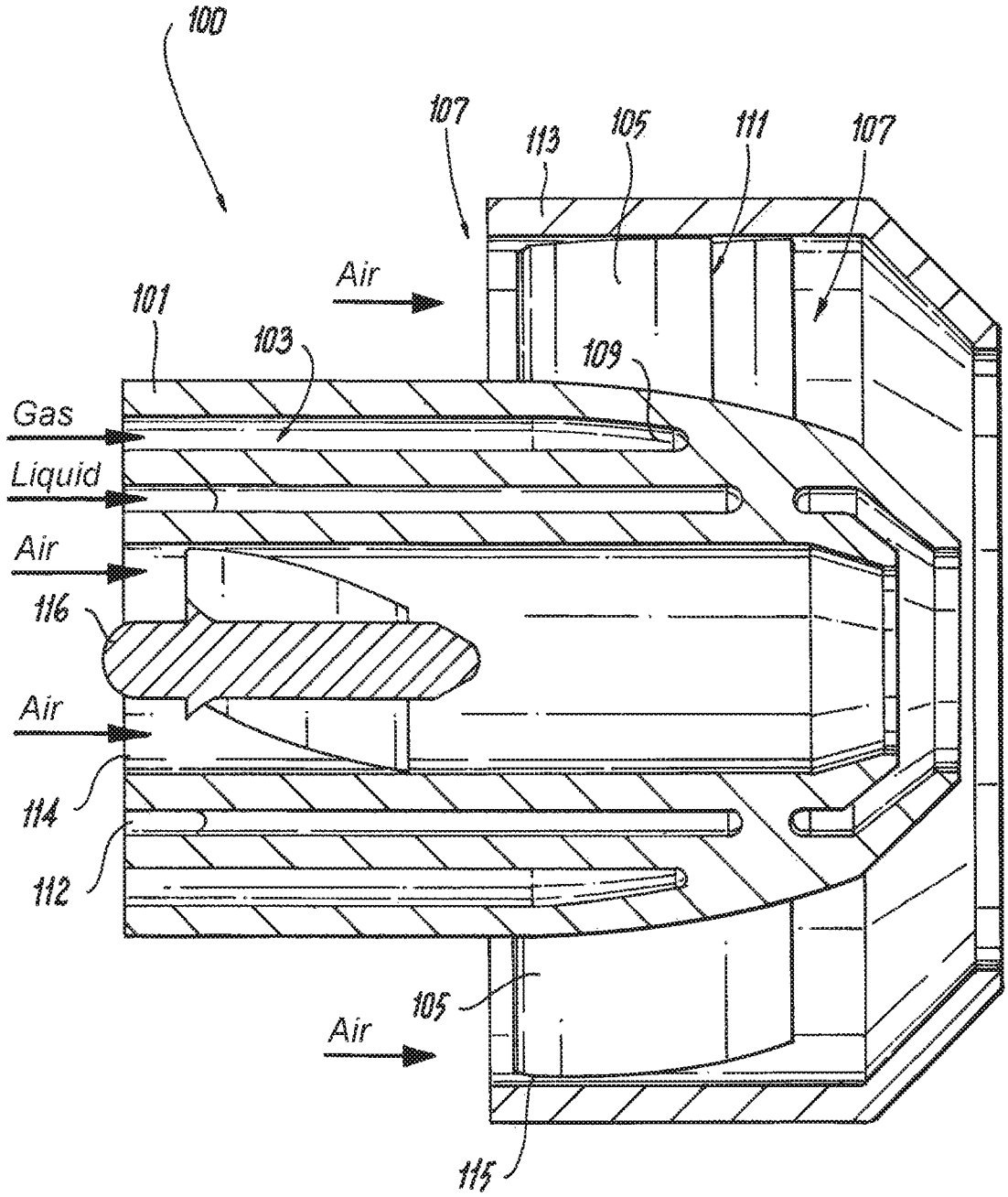
FIG. 1 is a cross-sectional view of an embodiment of a fuel injector in accordance with this disclosure.

Reference will now be made to the drawings wherein like reference numerals identify similar structural features or aspects of the subject disclosure. For purposes of explanation and illustration, and not limitation, an illustrative view of an embodiment of a fuel nozzle in accordance with the disclosure is shown in FIG. 1 and is designated generally by reference character 100. Other embodiments and/or aspects of this disclosure are shown in FIGS. 2-14. The systems and methods described herein can be used to reduce and/or eliminate backflow, improve air wiping of potential carbon buildup surfaces, improve gas mixing, and/or for any other suitable purpose.

Figure 2:
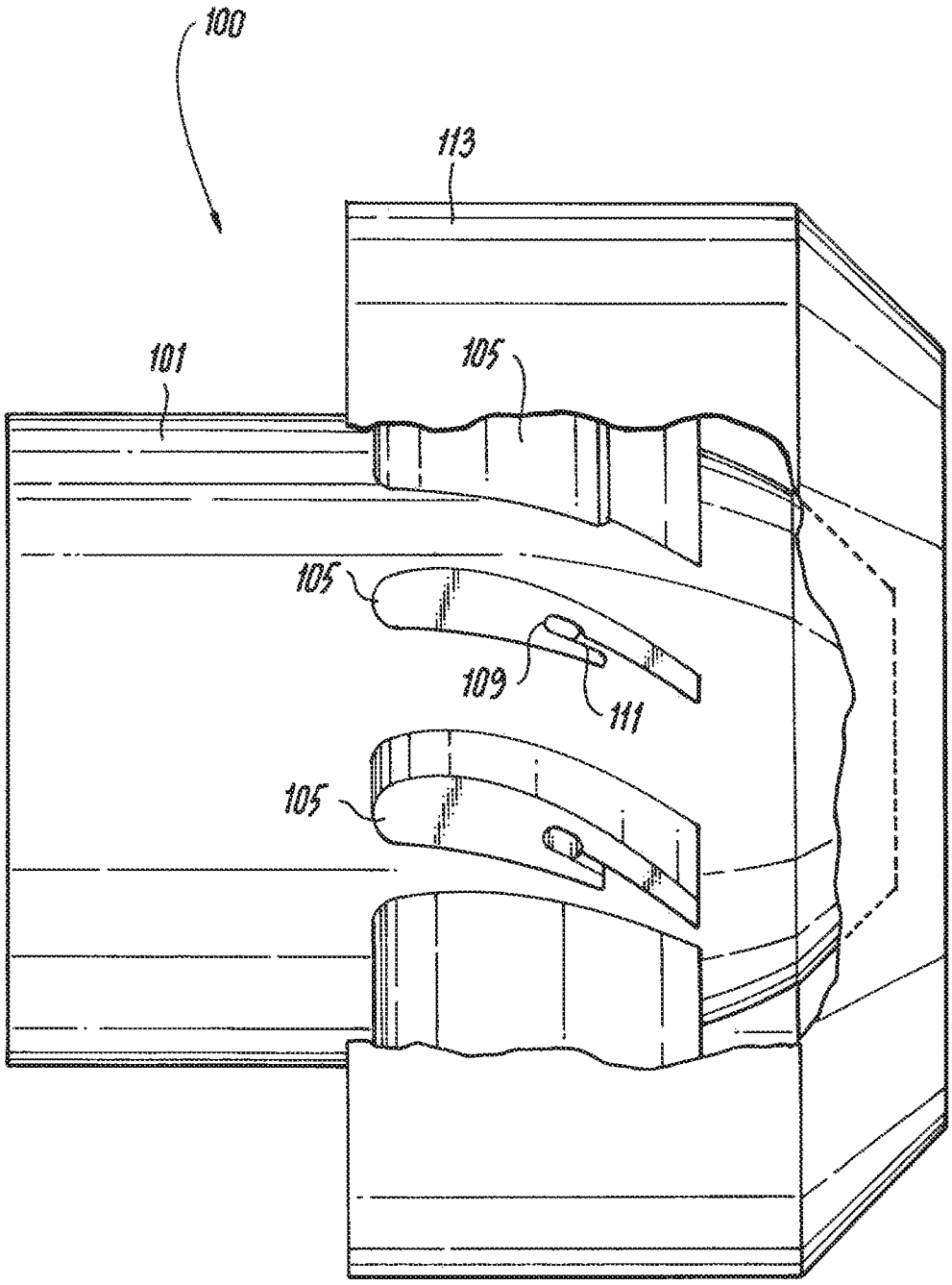
FIG. 2 is a partial cut-away view of an the embodiment of FIG. 1.

In accordance with at least one aspect of this disclosure, referring to FIGS. 1 and 2, a fuel injector 100 (e.g., which can be a tip of a fuel injector system) can include an annular body 101 defining a gas fuel inlet 103 therein. The gas fuel inlet 103 can include any suitable shape (e.g., an annular cavity defined in the annular body 101 and/or individual axial channels defined in the annular body 101).

Figure 3:
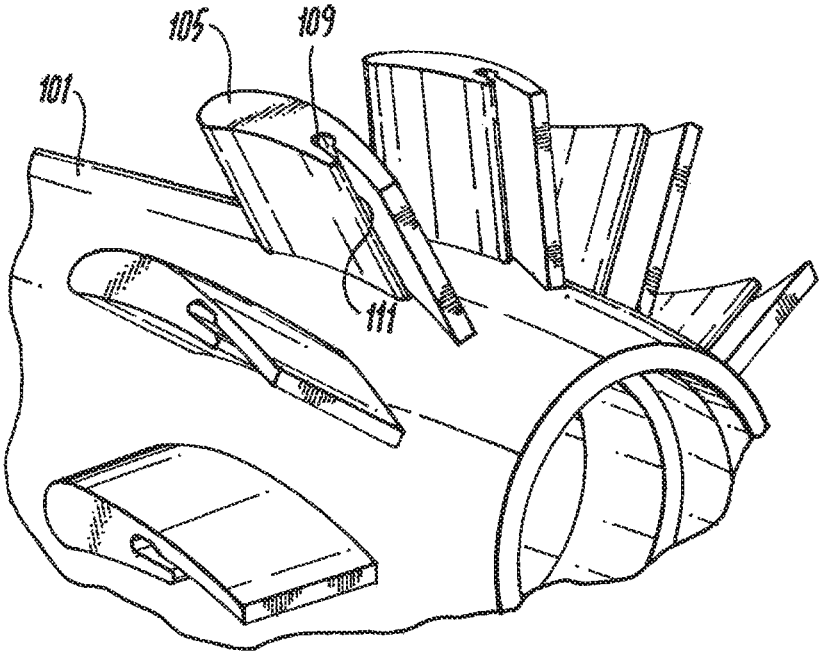
FIG. 3 is an isolated view of a portion of the embodiment of FIG. 1.
Figure 4:
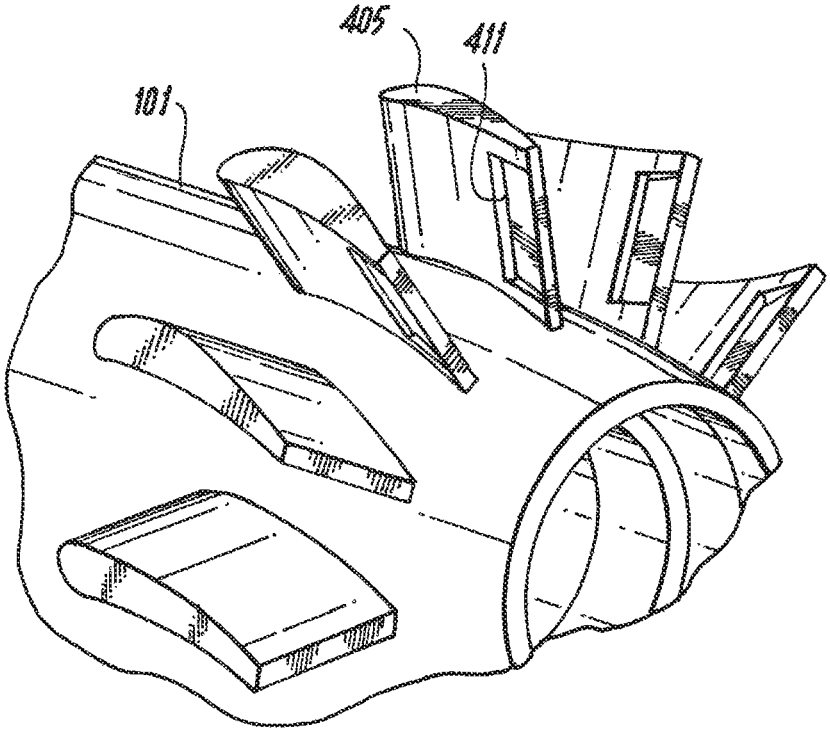
FIG. 4 is an isolated view of a portion of another embodiment in accordance with this disclosure, showing a slot opening defined partially along a radial length of a plurality of structures.

The fuel injector 100 can include a structure 105 extending radially outward from the annular body 101 and configured to extend into an air circuit 107. The structure 105 can include a gas channel 109 defined within the structure 105 at least partially along a radial length 110 (e.g., the radial length as shown in FIG. 3) of the structure 105. The gas channel 109 is in fluid communication with the gas fuel inlet 103 where the structure 105 meets the annular body 101. The structure 105 also includes a slot opening 111 defined at least partially along a radial length 110 of the structure 105 and configured to fluidically connect the gas channel 109 and the air circuit 107 to all gas fuel to effuse into the air circuit 107.

In certain embodiments, as shown, the fuel injector 100 can include a plurality of the structure 105. However, it is contemplated that the fuel injector 100 can include a single structure 105 for introducing gaseous fuel into the air circuit 107 and other structures can be solid vanes or support structures.

In certain embodiments, the fuel injector 100 can include an air shroud 113 attached to (e.g., via brazing) or formed from (e.g., via additive manufacturing) a radially outward end 115 of the structure 105 to define the air circuit 107. It is contemplated herein the air shroud 113 can be disposed on or attached to the annular body 101 in any other suitable manner.

In certain embodiments, at least some of the structures 105, e.g., all as shown in FIGS. 1 and 2, can include an airfoil shape such that the structure 105 is also a vane of an air swirler (e.g., shown comprised of structures 105) that is configured to swirl air in the air circuit 107. Any suitable vane geometry is contemplated herein. For example, certain embodiments do not have air swirling and only have straight struts for structures 105, for example.

It is contemplated that one or more, e.g., all, of the structures 105 need not extend across the entire air circuit 107 and can be any suitable radial length. For example, the structures 105 may only extend partially into the air circuit 105 and the air shroud 113 can be supported on the annular body 101 in any other suitable manner by any other suitable support (e.g., a solid vane).

Referring additionally to FIG. 3, in certain embodiments, the gas channel 109 and the slot opening 111 can be defined along the entire length of the structure 105. However, referring additionally to FIG. 4, the gas channel 109 (not shown in FIG. 4) and/or the slot opening 411 of structure 405 can be defined only partially along the radially length of the structure 105. It is contemplated that the gas channel 109 can be longer than the slot 111 opening, or vice versa.

In certain embodiments, the fuel injector 100 can include a liquid fuel circuit 112 and/or an inner air flow channel 114 defined by the annular body 101. The inner air flow channel 114 can include an inner air swirler 116, for example.

Figure 5:
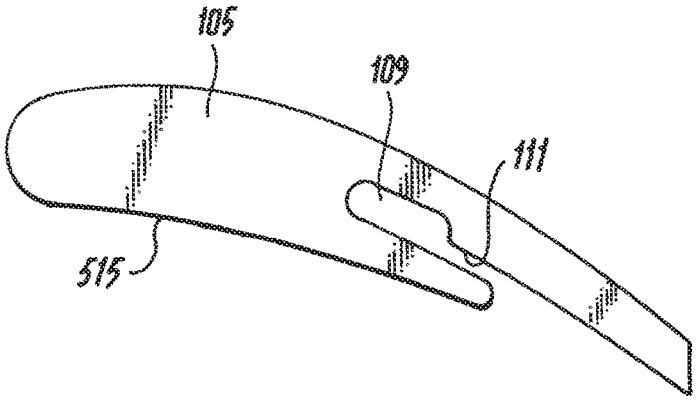
FIG. 5 is a cross-sectional plan view of an embodiment of a structure in accordance with this disclosure.
Figure 6:
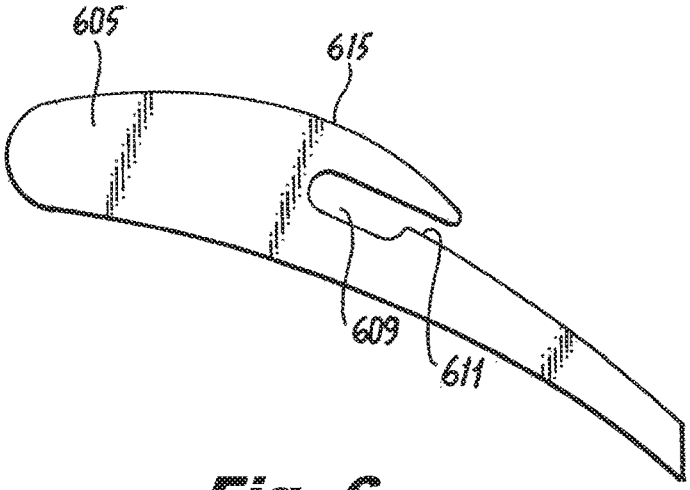
FIG. 6 is a cross-sectional plan view of an embodiment of a structure in accordance with this disclosure.
Figure 7:
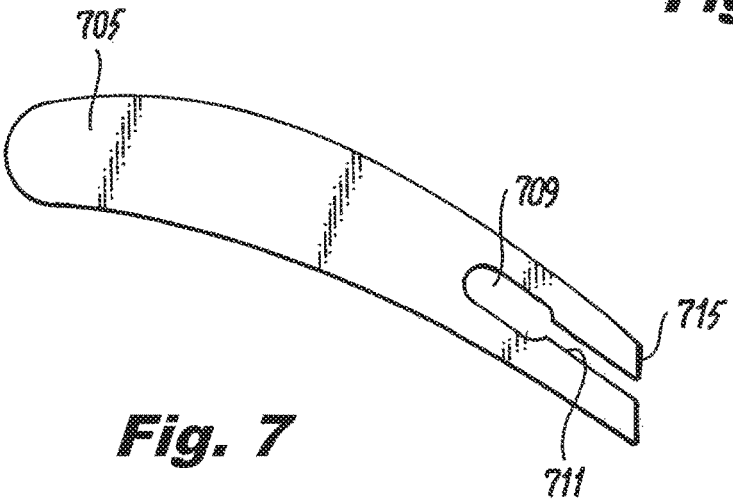
FIG. 7 is a cross-sectional plan view of an embodiment of a structure in accordance with this disclosure.
Figure 8:
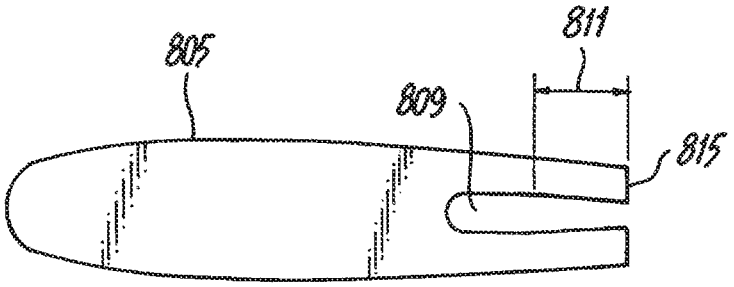
FIG. 8 is a cross-sectional plan view of an embodiment of a structure in accordance with this disclosure.
Figure 9:
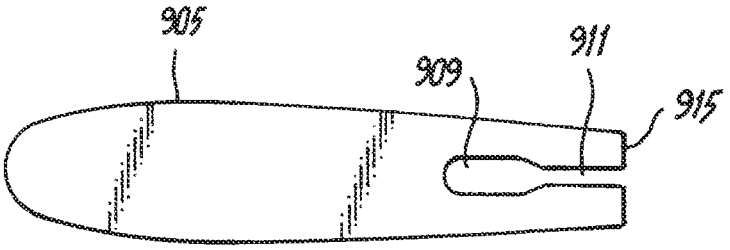
FIG. 9 is a cross-sectional plan view of an embodiment of a structure in accordance with this disclosure.

As shown in in FIGS. 1-4, and additionally in FIG. 5, in certain embodiments where the structure 105 has an airfoil shape, the slot opening 111 can be defined through a concave high pressure side 515 of the airfoil shape. Referring to FIG. 6, in certain embodiments, the slot opening 611 can be defined through a convex low pressure side 615 of the airfoil shape in fluid communication with the gas channel 609 of the structure 605. In certain embodiments, the slot opening 711 can be defined in a trailing edge 715 of the airfoil shape in fluid communication with the gas channel 709 of the structure 705. In certain embodiments, as shown in FIGS. 8 and 9, the structure 805, 905 can include a symmetric airfoil shape or a non-airfoil shape and the slot opening 811, 911 can be defined in the trailing edge 815, 915 in fluid communication with the gas channel 809, 909 of the structure 805, 905.

The gas channel 105, 605, 705, 805, 905 can be sized and/or shaped relative to the slot opening 111, 411, 611, 711, 811, 911 to cause uniform flow distribution through the slot opening, e.g., to cause flow ribboning of the gaseous fuel into the air stream. For example, the slot opening 111, 411, 611, 711, 811, 911 can constrict flow from the gas channel 105, 605, 705, 805, 905 (e.g., to affect pressure to cause gas to fill the gas channel uniformly). This can be accomplished by a stepped or smooth reduction in flow area to a constant flow area, e.g., as shown in FIGS. 1-7 and 9. In certain embodiments, e.g., as shown in FIG. 8, the gas channel 809 and the slot opening 811 can be defined by a single smoothly reducing channel to the opening with no constant flow area section of the slot opening 811. The smoothly reducing channel can define a smooth cross-sectional reducing shape, without an edge defined therein.

FIGS. 10-14 show portions of various embodiments of fuel injectors in accordance with this disclosure, shown having only a gaseous fuel circuit for simplicity. Any suitable number of fuel circuits and/or additional types (e.g., liquid fuel) is contemplated herein.

Figure 10:
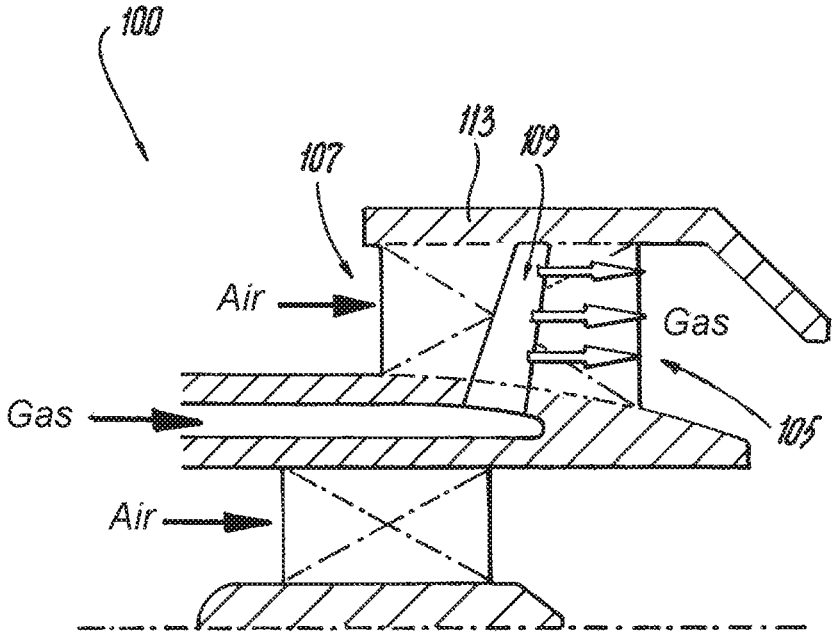
FIG. 10 is a schematic of a portion of an embodiment of a fuel injector in accordance with this disclosure.
Figure 11:
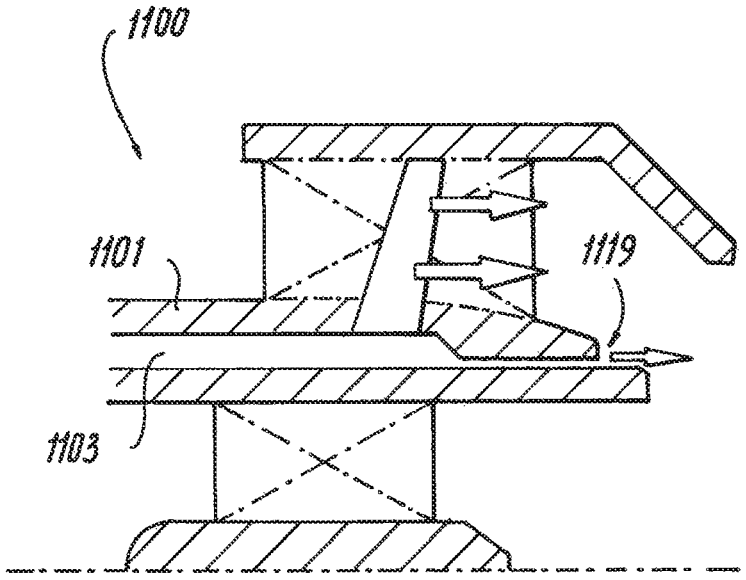
FIG. 11 is a schematic of a portion of an embodiment of a fuel injector in accordance with this disclosure.

Referring to FIG. 10, a schematic of the embodiment of FIG. 1 is shown. Gas fuel flow exits from structure 105 into the air stream in the air circuit 107. In certain embodiments, e.g., referring to FIGS. 11 and 12, the fuel injector 1100, 1200 can include an additional gas outlet 1119, 1219 to all gas fuel to effuse from the gas fuel inlet 1103, 1203. For example, as shown in FIG. 11, the additional gas outlet 1119 can be defined axially through the annular body 1101.

Figure 12:
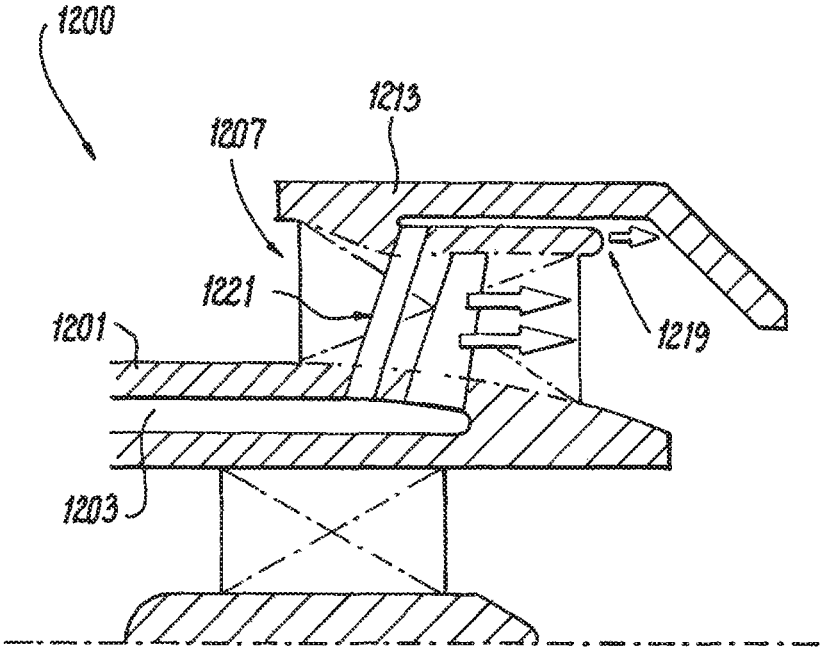
FIG. 12 is a schematic of a portion of an embodiment of a fuel injector in accordance with this disclosure.

In certain embodiments, e.g., as shown in FIG. 12, the additional gas outlet 1219 can be defined radially outward of the air circuit 1207 in the air shroud 1213 such that the additional gas outlet 1219 is in fluid communication with the air circuit 1207. The additional gas outlet 1219 can be in fluid communication with the gas fuel inlet 1203 of the annular body 1201 through a strut 1221 that includes a slot or passage therein, the strut 1221 passing through the air circuit 1207.

The strut 1221 can include an airfoil shape for example and can form part of an air swirler. The strut 1221 can be axially separated from the structure 105, or can be circumferentially disposed. For example, airfoils of an air swirler can alternate being a structure 105 as disclosed herein or a strut 1221.

Figure 13:
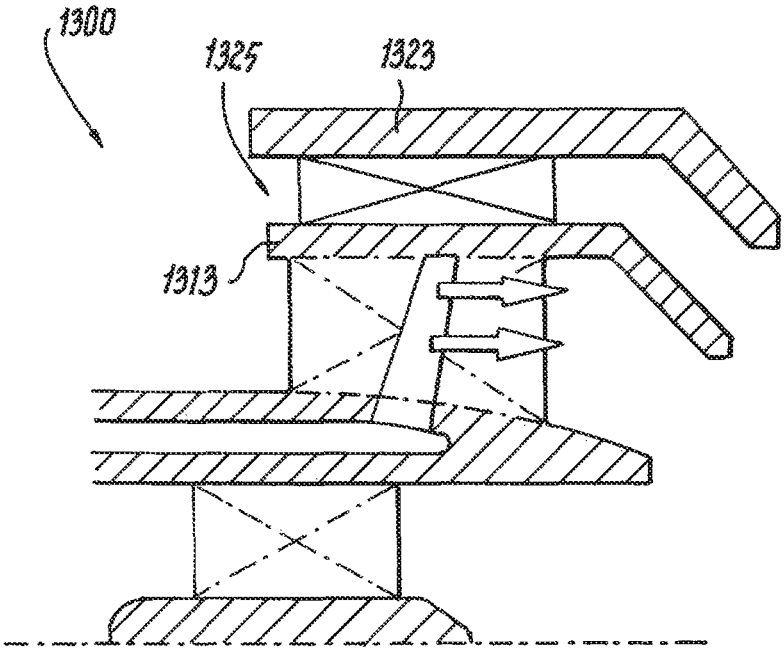
FIG. 13 is a schematic of a portion of an embodiment of a fuel injector in accordance with this disclosure.
Figure 14:
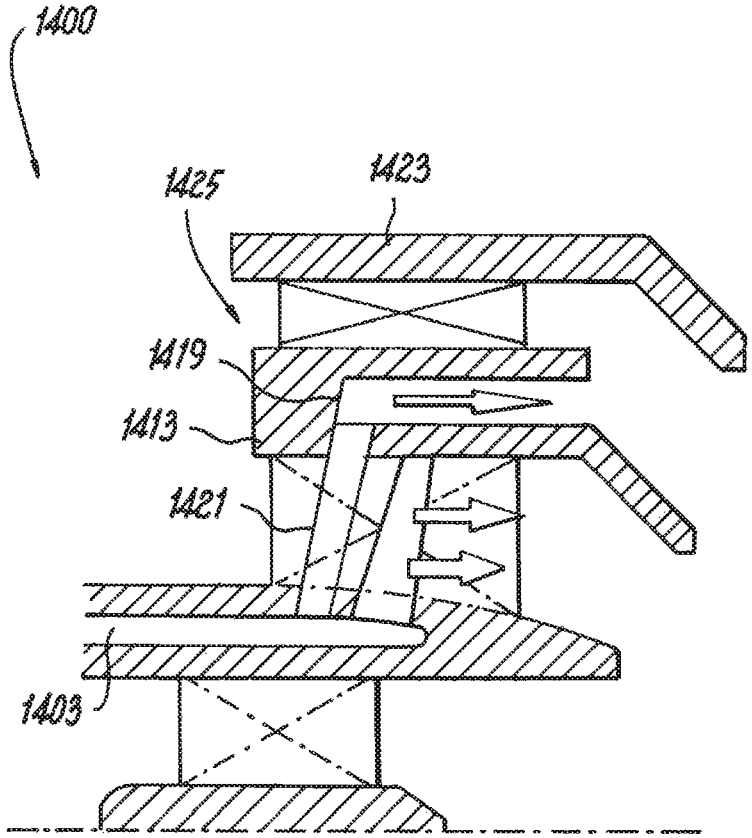
FIG. 14 is a schematic of a portion of an embodiment of a fuel injector in accordance with this disclosure.

In certain embodiments, e.g., refereeing to FIGS. 13 and 14, the fuel injector 1300, 1400 can include a second air shroud 1323, 1423 disposed radially outward of the air shroud 1313, 1413 that is formed from or attached to the structure 105. The second air shroud 1323, 1423 can define a second air circuit 1325, 1425. In certain embodiments, an additional gas outlet 1419 can be included to allow gas fuel to effuse from the gas fuel inlet 1403. As shown in FIG. 14, the additional gas outlet 1419 can be defined between the air shroud 1413 that is formed from or attached to the structure 105 and the second air shroud 1425. The additional gas outlet 1419 can be connected to the gas fuel inlet 1403 through a strut 1421, e.g., similar to strut 1221 as described above, for example. The additional gas outlet 1419 can be in fluid communication with the second air circuit 1425 as shown.

In accordance with at least one aspect of this disclosure, a method for making a fuel injector, e.g., as described above, can include forming a structure as described above. Forming the structure can include additively manufacturing the structure, or forming the structure to include an entirely internal gas channel and cutting a trailing edge off of the structure to form the slot opening, for example. Any other suitable method of forming is contemplated herein.

In accordance with at least one aspect of this disclosure, an air circuit strut for a fuel injector can include a gas channel defined therein and open through a slot opening in fluid communication with air in the air circuit.

As appreciated by those having ordinary skill in the art and in view with this disclosure, a bigger feed area in the gas channel can cause little pressure drop such that to fill the structure with gas radially for uniform flow distribution in the slot opening. Embodiments can include any suitable number of upstream or downstream gas circuits (e.g., two separate upstream circuits for flexibility).

Embodiments allow gaseous fuel to travel through the vanes into an air circuit (e.g., having a swirler) swirler. Slot openings allow good mixing with air. Embodiments also change the geometry as compared to traditional injectors such that embodiments disclosed herein reduce or eliminates pull back of liquid fuel particles and/or cause adequate wiping of surfaces where deposits would form since there is not a separate large gas swirling circuit which prevents adequate wiping.

Embodiments for a non-premixed injector can include gaseous fuel passages that extend into the air circuit, e.g., at swirl vanes and exits the vane as a near collinear gap along the majority of air vane height. Embodiments alternatively or additionally can locate gaseous fuel exit(s) near the inner diameter or outer diameter of air circuit swirl vanes, e.g., where recirculation liquid fuel droplet is not possible. Embodiments eliminate or reduce propensity of liquid fuel backflow into gas or air circuits, improve the purge of gas circuit from previous designs, and provide options for better gas mixing into the air stream. Embodiments also allow for creation of designed local rich or lean zones and/or about a 50% more gaseous fuel surface area.

Embodiments can allow for the gas fuel to mix into the air stream without consequence of liquid fuel droplet recirculation and resulting carbon growth. Embodiments include greater surface area interaction and placement for rich/lean zones as desired for combustion performance.

Any suitable combination(s) of any disclosed embodiments and/or any suitable portion(s) thereof is contemplated therein as appreciated by those having ordinary skill in the art.

Those having ordinary skill in the art understand that any numerical values disclosed herein can be exact values or can be values within a range. Further, any terms of approximation (e.g., "about", "approximately", "around") used in this disclosure can mean the stated value within a range. For example, in certain embodiments, the range can be within (plus or minus) 20%, or within 10%, or within 5%, or within 2%, or within any other suitable percentage or number as appreciated by those having ordinary skill in the art (e.g., for known tolerance limits or error ranges).

The embodiments of the present disclosure, as described above and shown in the drawings, provide for improvement in the art to which they pertain. While the subject disclosure includes reference to certain embodiments, those skilled in the art will readily appreciate that changes and/or modifications may be made thereto without departing from the spirit and scope of the subject disclosure.

What is claimed is:

1. A fuel injector, comprising:

an annular body defining a gas fuel inlet therein; and a structure extending radially outward from the annular body and configured to extend into an air circuit, the structure defining:

a gas channel defined within the structure, wherein the gas channel is in fluid communication with the gas fuel inlet where the structure meets the annular body;

a slot opening defined within the structure and configured to fluidically connect the gas channel with the air circuit to allow gas fuel to effuse into the air circuit; and an air shroud attached to or formed from a radially outward end of the structure to define the air circuit, wherein the structure comprises an airfoil shape such that the structure is a vane of an air swirler that is configured to swirl air in the air circuit, wherein the slot opening is disposed proximate to a trailing edge of the vane and is defined through a concave high pressure side of the airfoil shape, wherein the gas channel and the slot opening are defined along the entire radial length of the structure, wherein the slot opening constricts flow from the gas channel.

2. The fuel injector of claim 1, further comprising a plurality of the structure.

3. The fuel injector of claim 1, further comprising an additional gas outlet to all gas fuel to effuse from the gas fuel inlet.

4. The fuel injector of claim 3, wherein the additional gas outlet is defined axially through the annular body.

5. The fuel injector of claim 3, wherein the additional gas outlet is defined radially outward of the air circuit in the air shroud in fluid communication with the air circuit, wherein the additional gas outlet is in fluid communication with the gas fuel inlet of the annular body through a strut that passes through the air circuit.

6. The fuel injector of claim 1, further comprising a second air shroud disposed radially outward of the air shroud that is formed from or attached to the structure, wherein the second air shroud defines a second air circuit.

7. The fuel injector of claim 6, further comprising an additional gas outlet to all gas fuel to effuse from the gas fuel inlet, wherein the additional gas outlet is defined between the air shroud that is formed from or attached to the structure or the second air shroud, wherein the additional gas outlet is in fluid communication with the second air circuit.

8. The fuel injector of claim 1, further comprising a liquid fuel circuit and/or an inner air flow channel defined by the annular body.

9. The fuel injector of claim 8, wherein the inner air flow channel includes an inner air swirler.

10. A method for making a fuel injector, comprising:

forming a structure that extends radially outward from an annular body and configured to extend into an air circuit, the structure defining:

a gas channel defined within the structure, wherein the gas channel is in fluid communication with the gas fuel inlet where the structure meets the annular body;

a slot opening defined within the structure and configured to fluidically connect the gas channel with the air circuit to allow gas fuel to effuse into the air circuit; and an air shroud attached to or formed from a radially outward end of the structure to define the air circuit, wherein the structure comprises an airfoil shape such that the structure is a vane of an air swirler that is configured to swirl air in the air circuit, wherein the slot opening is disposed proximate to a trailing edge of the vane and is defined through a concave high pressure side of the airfoil shape, wherein the gas channel and the slot opening are defined along the entire radial length of the structure, wherein the slot opening constricts flow from the gas channel.

* * * * *